US007958870B2

(12) United States Patent
Bonfigli et al.

(10) Patent No.: US 7,958,870 B2
(45) Date of Patent: Jun. 14, 2011

(54) FUEL LANCE AND ASSEMBLY

(75) Inventors: Fabrizio A. Bonfigli, Mont pres Chambord (FR); Philippe Legrand, St. Gervais la Foret (FR); Emmanuel Autret, Blois (FR); Robert A. D'Aubyn, Bath (GB); Simon H. Phillips, Coleford (GB)

(73) Assignee: Delphi Technologies Holdings S.arl, Troy, MI (US)

( * ) Notice: Subject to any disclaimer, the term of this patent is extended or adjusted under 35 U.S.C. 154(b) by 267 days.

(21) Appl. No.: 12/291,671

(22) Filed: Nov. 12, 2008

(65) Prior Publication Data

US 2009/0183713 A1 Jul. 23, 2009

(30) Foreign Application Priority Data

Nov. 13, 2007 (EP) ..... 07254437

(51) Int. Cl.
*F02M 61/14* (2006.01)
*F02M 55/02* (2006.01)

(52) U.S. Cl. ..... 123/470; 123/468

(58) Field of Classification Search ..... 123/470, 123/468, 469, 472; 285/382.5, 286.1, 286.2, 285/382.4, 382; 403/334
See application file for complete search history.

(56) References Cited

U.S. PATENT DOCUMENTS 2,897,800 A * 8/1959 Haas ..... 123/470
5,365,907 A * 11/1994 Dietrich et al. ..... 123/470
5,775,303 A * 7/1998 Sweetland et al. ..... 123/470
6,234,413 B1 * 5/2001 Greaney ..... 239/533.2
6,279,540 B1 * 8/2001 Greaney et al. ..... 123/470

FOREIGN PATENT DOCUMENTS

| | | |
|---|---|---|
| DE | 31 28 523 | 2/1983 |
| EP | 0 921 303 | 6/1999 |
| EP | 0 974 749 | 1/2000 |
| EP | 1 108 886 | 6/2001 |
| GB | 925 937 | 5/1963 |

OTHER PUBLICATIONS

European Search Report Dated Apr. 3, 2008.

* cited by examiner

*Primary Examiner* — Mahmoud Gimie
(74) *Attorney, Agent, or Firm* — Thomas N. Twomey

(57) ABSTRACT

A fuel lance assembly for an engine comprises: a fuel lance to be received in a passage provided in a cylinder head and a connection arrangement comprising an inlet adapter for securing the fuel lance within the passage. The fuel lance comprises a tubular member of constant external diameter, arranged to be received, in use, within the passage and having a first end being shaped for cooperation with a seating surface of a fuel injector of the engine, and a second end being shaped for cooperation with the inlet adapter, and being provided with a bore therethrough to define a fuel flow path between the first end and the second end of the fuel lance. The inlet adapter is provided with an attachment system for engaging a compatible attachment system of the cylinder head, and has a proximal region for receiving a high pressure fuel pipe, and wherein the inlet adapter has a distal region provided with an opening being adapted to receive the second end of the fuel lance. A fuel lance and a fuel supply line arrangement are also provided.

29 Claims, 8 Drawing Sheets

FUEL LANCE AND ASSEMBLY

FIELD OF THE INVENTION

This invention relates to a connector for use in connecting a supply of fuel under high pressure to a fuel injector. In particular, the invention relates to a fuel lance for use in an arrangement of the type wherein an injector is located within a bore provided in an engine cylinder head, the fuel being supplied through the cylinder head to the injector.

BACKGROUND OF THE INVENTION

In an internal combustion engine, it is known for a fuel pump to supply fuel at high-pressure for delivery to each cylinder of the engine by means of a dedicated fuel injector. Typically, the fuel injector is received within a bore provided in a cylinder head of the cylinder, and a connector (or fuel lance) is used to provide a fluid connection between the fuel injector and a fuel supply line (or pipe) from a fuel pump or accumulator volume/common rail.

Such an arrangement is known from EP 0569727, as shown in FIG. 1. A connector 1 is disposed within a transverse bore 3 in a cylinder head 5 that intersects with a bore 7, in which the injection nozzle 9 is housed. The connector 1 has a spherical taper 11 on its outlet end to form a fluid tight seal against a lateral seating face 13 on the injection nozzle 9 when it is clamped in place by means of a retaining screw 15. To firmly seal the connector 1 against the injection nozzle 9, the retaining screw 15 has an external screw thread that cooperates with an internal screw thread provided in the transverse bore 3 of the cylinder head 5. A spherical shoulder 17 is also provided on the connector 1, against which the retaining screw 15 presses when tightened. As clearly indicated, the inlet end section 19 of connector 1 projects beyond the retaining screw 15 and the cylinder head 5 in order that the fuel pipe 21 may be clamped in place. The inlet end section 19 is provided with an external thread 23 onto which a female pipe nut 25 is screwed to clamp the fuel pipe 21 to the end of the connector 1. The inlet end section 19 of the connector 1 is further provided with a female conical seating surface 27 about the fuel passage 29 that passes through the connector 1, against which a male conical seating surface 31 of the fuel pipe 21 seals when the pipe nut 25 is tightened.

However, the prior art fuel supply line arrangements for connecting a fuel pipe to an injection nozzle have a number of disadvantages. By way of example, the shoulder (or flange) on the connector that is required to transfer the load from the retaining screw to the conical (or spherical) sealing face at the injector end of the connector adds to the complexity of manufacture and prohibits the use of a smaller diameter connector, which would reduce the cost of manufacture. Furthermore, the prior art connectors are typically considerably longer than the length of the bore of the cylinder head, in which they are located. Therefore, the connector extends beyond the cylinder head and takes up a significant amount of space within the engine, which can cause packing conflicts with other components fixed in the region of the cylinders. The length of such prior art connectors also adds to the cost of manufacturing this component. Thus, there is a need for a fuel connector/lance that provides design and manufacturing cost benefits and/or which achieves installation benefits over the prior art.

A further issue with some prior art fuel supply line arrangements, such as that already described, is that a tight seal between the connector and the injection nozzle requires the tightening of a retaining screw into the cylinder head and the transfer of the load from the screw through the connector.

This mechanism thus requires the rotation of tightly fitting parts and the friction between the rotating components can lead to the generation of undesirable particles (debris), which could lead to the contamination of fuel and/or the wearing of the components. In addition, an anti-rotation device may be necessary on the connector to prevent it rotating within the cylinder head, further adding to design complexity and manufacturing costs. It would be further desirable to provide a fuel supply line arrangement that reduces or eliminates the requirement for the rotation of components within the cylinder head during assembly and/or disassembly.

The invention relates to a fuel connector or lance that overcomes or at least alleviates at least one of the above-mentioned problems and disadvantages in the prior art, and also to fuel supply line arrangements comprising such a fuel connector or lance.

In broad terms, the invention provides a fuel lance, a fuel lance assembly, and a fuel supply line arrangement that provides all necessary functionality and which provides desirable advantages over the prior art, such as greater simplicity and, therefore, a lower cost of manufacture. It may also avoid prior art design limitations on the size of various parts, such that it takes up less space within the increasingly complex and crowded engine space. In some embodiments, the apparatus of the invention provides functional benefits in terms of reducing component wear and avoiding potential fuel contamination from worn engine components.

SUMMARY OF THE INVENTION

Accordingly, in one aspect the invention provides a fuel lance for use in supplying fuel to a fuel injector, the fuel lance comprising a tubular member arranged to be received, in use, within a passage provided in an engine cylinder head, the tubular member being shaped, at a first end thereof, for cooperation with a seating surface of the fuel injector and at a second end for cooperation with a connection arrangement comprising an inlet adapter, and having a bore to define a fluid flow path between the fuel injector and the connection arrangement. The tubular member of the fuel lance has a constant external diameter, and the fuel lance is shorter than the passage of the cylinder head such that, in use, the fuel lance can be fully received within the passage. The fuel lance is provided with an external (outer) circumferential groove to receive a thrust clip for engagement with a surface of the inlet adapter, such that when the lance is secured within the passage of the cylinder head by the inlet adapter, the surface of the inlet adapter exerts an axial load through the thrust clip along the length on the lance to provide a sealing pressure between the first end of the lance and the seating surface of the fuel injector. Suitably, the second end of the fuel lance is arranged to be receivable within an opening in the inlet adapter.

In another aspect the invention provides a fuel lance assembly for an engine comprising a fuel injector to be located within a bore of an engine cylinder head; the fuel lance assembly comprising: a fuel lance to be received in a passage provided in the cylinder head and an inlet adapter for securing the fuel lance within the passage; the fuel lance comprising a tubular member arranged to be received, in use, within the passage and having a first (distal) end being shaped for cooperation with a seating surface of the fuel injector of the engine, and a second (proximal) end being shaped for cooperation with the inlet adapter, and having a bore therethrough to define a fuel flow path between the first end and the second end of the fuel lance; wherein the inlet adapter is arranged to be at least in part receivable within the passage of the cylinder head and is provided with an attachment system for engaging a compatible attachment system of the cylinder head, the inlet adapter further having a distal region provided with an opening being adapted to receive the second end of the fuel lance, and a proximal region for receiving a high pressure fuel pipe; and wherein the length of the fuel lance is shorter than the length of the passage of the cylinder head such that, in use, the fuel lance can be fully received within the passage, and wherein the tubular member of the fuel lance has a constant external diameter. The fuel lance is provided with an external (outer) circumferential groove to receive a thrust clip for engagement with a surface of the inlet adapter, such that when the lance is secured within the passage of the cylinder head by the inlet adapter, the surface of the inlet adapter exerts an axial load through the thrust clip along the length on the lance to provide a sealing pressure between the first end of the lance and the seating surface of the fuel injector.

Suitably, in this aspect of the invention, the inlet adapter is provided with a radially extending circumferential flange, the flange having at least one axial through bore for receiving a fixing member, in use, to be aligned with at least one fixing member hole provided in the cylinder head of the engine for attaching the inlet adapter to the cylinder head by use of the at least one fixing member (as described in relation to the first aspect of the invention).

In yet another aspect the invention provides a fuel lance assembly for an engine comprising a fuel injector to be located within a bore of an engine cylinder head, the fuel lance assembly comprising: a fuel lance to be received in a passage provided in the cylinder head and a connection arrangement comprising an inlet adapter for securing the fuel lance within the passage. The fuel lance comprises a tubular member of constant external diameter and arranged to be received, in use, within the passage and has a first end (or distal end) being shaped for cooperation with a seating surface of the fuel injector, and a second end (or proximal end) being shaped for cooperation with the connection arrangement, and a bore therethrough to define a fuel flow path between the first end and the second end of the fuel lance. The inlet adapter is provided with an attachment system for engaging a compatible attachment system of the cylinder head and has a proximal region for receiving a high pressure fuel pipe. The inlet adapter further has a distal region provided with an opening (e.g. in the form of a bore) being adapted to receive the second end of the fuel lance.

Advantageously, in some embodiments, the length of the fuel lance is shorter than the length of the passage of the cylinder head such that, in use, the fuel lance can be fully received within the passage. In this way, the second end of the fuel lance does not protrude from the cylinder head when the lance is secured within the passage of the cylinder head.

Suitably, the inlet adapter is arranged to be at least in part received within the passage of the cylinder head (for example, at least the distal region thereof is beneficially received within the passage). In use, the inlet adapter clamps the first end of the fuel lance to the seating surface of the fuel injector such that a substantially fluid tight seal is formed between the fuel lance and the fuel injector. In some embodiments, the inlet adapter may be arranged to be fully received within the passage of the cylinder head, such that the proximal region thereof does not protrude from the cylinder head.

In one embodiment, the fuel lance is provided with an external circumferential groove (i.e. on the outer surface of the fuel lance) to receive a thrust clip for engagement with a surface of the inlet adapter, such that when the lance is secured within the passage of the cylinder head by the inlet adapter, the surface of the inlet adapter exerts an axial load through the thrust clip and along the length of the fuel lance to provide a sealing pressure between the first end of the fuel lance and the seating surface of the fuel injector. Suitably, the inner wall defining the opening of the inlet adapter which is arranged to receive the second end of the fuel lance is provided with an annular groove, wherein the distal facing surface of the groove is shaped to provide a conical surface for engagement with the thrust clip of the fuel lance. Thus, in this embodiment the thrust clip is located such that it is also received within the opening of the inlet adapter. The opening of the inlet adapter may have a stepped internal diameter, wherein the internal diameter of the opening distal to the annular groove (i.e. between the annular groove and the aperture of the opening) is of greater diameter than the internal diameter of the opening proximal to the groove. By "stepped" it will be understood that the internal diameter changes between a first and second location within the opening, and this change may conveniently be brought about by way of a step. However, a gradual change in the internal diameter of the opening (e.g. by way of a slope in the wall of the opening) may also be employed.

The fuel lance and inlet adapter may conveniently be arranged such that, in use (e.g. during assembly of the fuel supply line arrangement), the thrust clip of the fuel lance may be located in the annular groove of the inlet adapter, and wherein on disengaging the inlet adapter from the cylinder head (with the fuel lance also in place), the second end of the fuel lance is releasably retained in the opening. This arrangement provides the further benefit that the fuel supply line arrangement can be readily disassembled, suitably avoiding the need to extract separately the fuel lance from within the passage of the cylinder head.

In another embodiment, the distal region of the inlet adapter is adapted to receive an extraction clip, in use, for releasably retaining the second end of the fuel lance in the opening (by engagement with a thrust clip or like feature provided on the fuel lance) when the inlet adapter is disengaged and/or removed from the cylinder head.

In any of the embodiments of the invention, the inlet adapter and/or the fuel lance may be provided with an annular seal member arranged to form a substantially fluid tight seal between the inlet adapter and/or the fuel lance, respectively, and the wall of the cylinder head defining the passage.

The fuel lance assembly of the invention is arranged to provide a path of fluid communication between a high pressure fuel pipe and a fuel injector. Accordingly, the fuel lance assembly and, in particular, the fuel lance and/or the inlet adapter are arranged to engage a fuel pipe.

The fuel lance assembly suitably further comprises a pipe nut for receiving a fuel pipe and arranged, in use, to engage the proximal region of the inlet adapter, such that a fuel flow path is established between the passage of the fuel pipe and the bore of the fuel lance. In one embodiment, the pipe nut and inlet adapted are arranged to engage in such a way that the end of the fuel pipe directly cooperates with the second end of the fuel lance. In another embodiment, the end of the fuel pipe indirectly communicates with the fuel lance, for example, the end of the fuel pipe may cooperate with a seating surface of the inlet adapter and the inlet adapter is arranged such that the fuel pipe fluidly communicates with the bore of the fuel lance.

In a beneficial embodiment, the proximal end of the inlet adapter is provided with a bore arranged to receive at least a portion of the pipe nut and having an internal (or female) screw-thread over at least part of the length of the bore, and wherein the pipe nut is provided with an external (or male) screw-thread over at least a portion of its outer surface, in use, for engagement with the internal screw-thread of the inlet adapter. In another beneficial embodiment, the pipe nut is provided with a bore arranged to receive at least a length of the proximal region of the inlet adapter, at least a length of the bore being provided with a screw-thread (internal), in use, to cooperate with a screw-thread (external) provided over at least a part of the outer surface of the proximal region of the inlet adapter. In such embodiments, engagement of the pipe nut with the inlet adapter suitably creates a compressive force between the head (or end) of the fuel pipe and the second end of the fuel lance, or a seating surface of the proximal region of the inlet adapter, respectively, to create a substantially fluid tight seal between the fuel pipe and the fuel lance or inlet adapter. Suitably, the pipe nut is provided with a thrust surface to exert an axial load onto the end of the fuel pipe in order to compress the end of the fuel pipe against the cooperating surface of the fuel lance or inlet adapter.

Typically, the first (or distal) end of the lance is provided with a male frusto-conical or part-spherical surface for cooperation with a female frusto-conical or part-spherical seating surface of the fuel injector. Thus, in one embodiment, the fuel lance is provided with a frusto-conical seating surface at the first end, while in other embodiments a part-spherical surface is advantageous to compensate for any slight manufacturing inaccuracies.

The second (or proximal) end of the lance may be provided with a female frusto-conical or part-spherical surface to cooperate with a male frusto-conical end of the fuel pipe, such that engagement of the pipe nut with the inlet adapter creates a substantially fluid tight seal between the fuel pipe and the lance. As with the first end of the fuel lance, in some embodiments a part-spherical surface is advantageously employed at the second end of the lance to compensate for any slight manufacturing inaccuracies that may be present.

In some embodiments, the second end of the fuel lance is of male frusto-conical or part-spherical form, which may not be directly compatible (engageable) with a male frusto-conical or part-spherical surface of a fuel pipe. In such embodiments, the distal region of the inlet adapter may be provided with a female frusto-conical or part-spherical surface (at the proximal end of the opening of the inlet adapter) for cooperating with the male second end of the lance. Suitably, the proximal region of the inlet adapter is provided with a female frusto-conical or part-spherical surface for cooperating with the male end of the fuel pipe.

In alternative embodiments, even where the second end of the fuel lance is of female frusto-conical or part-spherical surface, the inlet adapter may still be used to indirectly couple the fuel lance to the fuel pipe. For example, the distal region of the inlet adapter may be provided with a male frusto-conical or part-spherical surface (at the proximal end of the opening of the inlet adapter) for cooperating with the female second end of the fuel lance; and the proximal region of the inlet adapter may be provided with a female frusto-conical or part-spherical surface for cooperating with the male end of the fuel pipe.

In one arrangement, the inlet adapter is connected to the cylinder head by means of a screw-threaded engagement. For example, a male screw-thread over at least a portion of the outer surface of the inlet adapter, and a female screw-thread over at least a length of the inner surface of the passage through the cylinder head. Typically, the male screw-thread on the external surface of the inlet adapter is provided over at least a portion of the proximal region of the inlet adapter.

In an alternative arrangement, the inlet adapter is advantageously connectable to the cylinder head by means of a fixing member. In a suitable embodiment the fixing member comprises at least one bolt or screw which is located between the inlet adapter and the cylinder head. In this arrangement, the inlet adapter is conveniently provided with a radially extending circumferential flange, the flange having at least one axial through-bore extending from the proximal side to the distal side of the flange. Each of the at least one through-bore is adapted to receive a fixing member, such as a bolt or screw. Suitably, the cylinder head is thus also provided with at least one fixing member hole (e.g. in the form of a screw-threaded bore) arranged, in use, to axially align with the at least one axial through bore of the flange when the inlet adapter is correctly received within the passage of the cylinder head. In this way, a fixing member can be passed through the axial through-bore of the flange and into the fixing member hole of the cylinder head in order to secure the inlet adapter to the cylinder head. Suitably, the inlet adapter is provided with a flange having two through-bores for mounting to the cylinder head using two fixing members, such as bolts. Advantageously in these embodiments, it is not necessary to twist (rotate) the inlet adapter into the cylinder head, so there is reduced frictional between the components, and less wear on the cooperating surfaces of the inlet adapter and the cylinder head. This arrangement thus provides the benefit of a reduced production of unwanted particulate matter that may contaminate the fuel supply and lead to failure of the engine components.

More suitably, in such embodiments, when the inlet adapter is correctly assembled in a fuel lance assembly of the invention and, for example, received within the passage of the cylinder head, the distal side of the flange is axially spaced from the opposing surface of the cylinder head. In this way, when the fuel lance is secured within the passage of the cylinder, the axial load between the at least one fixing member and the flange of the inlet adapter is transmitted from the inlet adapter to the lance (rather than to the cylinder head), to provide a sealing pressure between the first end of the fuel lance and the seating surface of the fuel injector.

Conveniently, the fuel lance is formed from a plastics material. It may be advantageous for the frusto-conical or part-spherical surfaces at the first and second ends of the fuel lance to be heat-treated to provide a hard surface to minimize plastic deformation. In other embodiments it may be advantageous for the ends of the fuel lance to slightly deform on engagement with the fuel injector and inlet adapter, for example, to create a tighter seal against potential fuel leaks.

In some embodiments, the distal region of the inlet adapter may comprise an external guide to restrict angular movement within the passage of the cylinder head.

In some embodiments, the inlet adapter and/or the fuel lance may be provided with an integrated filter member (for example, an edge filter), arranged within the fuel flow path between the fuel injector and the fuel pipe to remove particulate matter.

The invention further relates to a fuel lance for use in supplying fuel to a fuel injector, the fuel lance comprising a tubular member arranged to be received, in use, within a passage provided in an engine cylinder head, the tubular member being shaped, at a first end thereof, for cooperation with a seating surface of the fuel injector and at a second end for cooperation with a connection arrangement comprising an inlet adapter, and having a bore to define a fluid flow path between the fuel injector and the connection arrangement; wherein the tubular member of the fuel lance has a constant external diameter. Beneficially, the fuel lance may be shorter than the passage of the cylinder head such that, in use, the fuel lance can be fully received within the passage.

The second end of the fuel lance is arranged to be receivable within an opening (e.g. a bore) in the inlet adapter.

The fuel lance is conveniently provided with a region of part-spherical form to permit a degree of articulation between the inlet adapter and the fuel lance at the interface of the cooperating surfaces. In this way, any inaccuracies in the machining of the inlet adapter and/or the fuel lance may be compensated by the tolerance in the cooperation between the respective seating surfaces.

Advantageously, the fuel lance carries an annular seal member, for example, in the form of a resilient rubber ring, arranged to form a substantially fluid tight seal between the lance and the wall of the cylinder head defining the passage. The fuel lance may be provided with an external annular (circumferential) groove, in which the seal member can be located.

Suitably, the fuel lance may be provided with an external (outer) circumferential groove to receive a thrust clip for engagement with a surface of the inlet adapter, such that when the lance is secured within the passage of the cylinder head by the inlet adapter, the surface of the inlet adapter exerts an axial load through the thrust clip along the length on the lance to provide a sealing pressure between the first end of the lance and the seating surface of the fuel injector.

The fuel lance may further comprise a filter member located within the bore of the fuel lance.

It should be appreciated that the fuel lance may be provided with any or all of the features of the fuel lance described with regard to the preceding or following aspects of the invention.

In a further aspect, the invention provides a fuel supply line arrangement for an engine comprising a fuel injector to be located within a bore of an engine cylinder head, a fuel lance to be received in a passage provided in the cylinder head and a connection arrangement comprising an inlet adapter for securing the fuel lance within the passage. The fuel lance comprises a tubular member arranged to be received, in use, within the passage and has a first end (or distal end) being shaped for cooperation with a seating surface of the fuel injector, and a second end (or proximal end) being shaped for cooperation with the connection arrangement, and a bore therethrough to define a fuel flow path between the first end and the second end of the fuel lance. The inlet adapter is arranged to be at least in part receivable within the passage of the cylinder head and is provided with an attachment system for engaging a compatible attachment system of the cylinder head. The inlet adapter further has a distal region provided with an opening being adapted to receive the second end of the fuel lance, and a proximal region for receiving a high pressure fuel pipe. Advantageously, the length of the fuel lance is shorter than the length of the passage of the cylinder head such that, in use, the fuel lance can be fully received within the passage, and the tubular member of the lance has a constant external diameter.

In another aspect the invention provides a fuel supply line arrangement for an engine comprising a fuel injector to be located within a bore of an engine cylinder head; a fuel lance to be received in a passage provided in the cylinder head; a connection arrangement comprising an inlet adapter for securing the fuel lance within the passage; and a pipe nut for receiving a high pressure fuel pipe.

It will be appreciated that the fuel lance in any aspect of the invention may comprise any of the features described in relation to any other aspect of the invention or elsewhere herein. Likewise, the connection arrangement and the inlet adapter in any aspect of the invention may comprise any of the features described in relation to any other aspect of the invention and elsewhere herein. Equally, the pipe nut of any aspect of the invention may comprise any of the features of the pipe nut described in relation to any other aspect of the invention and elsewhere herein.

The invention also relates to an internal combustion engine having therein a fuel supply line arrangement, a fuel lance assembly or a fuel lance in accordance with the invention.

Advantageously, in some embodiments of the above aspects, the fuel lance and the fuel lance assemblies are arranged to be of such a length that the fuel lance and the inlet adapter when engaged with the fuel lance are fully received within the fuel lance passage of the cylinder head, such that none of the fuel lance assembly protrudes from the cylinder head into the engine space.

These and other aspects, objects and the benefits of this invention will become clear and apparent on studying the details of this invention and the appended claims.

BRIEF DESCRIPTION OF THE DRAWINGS

The invention will further be described, by way of example, with reference to the accompanying drawings, in which.

DETAILED DESCRIPTION OF INVENTION

Figure 1:
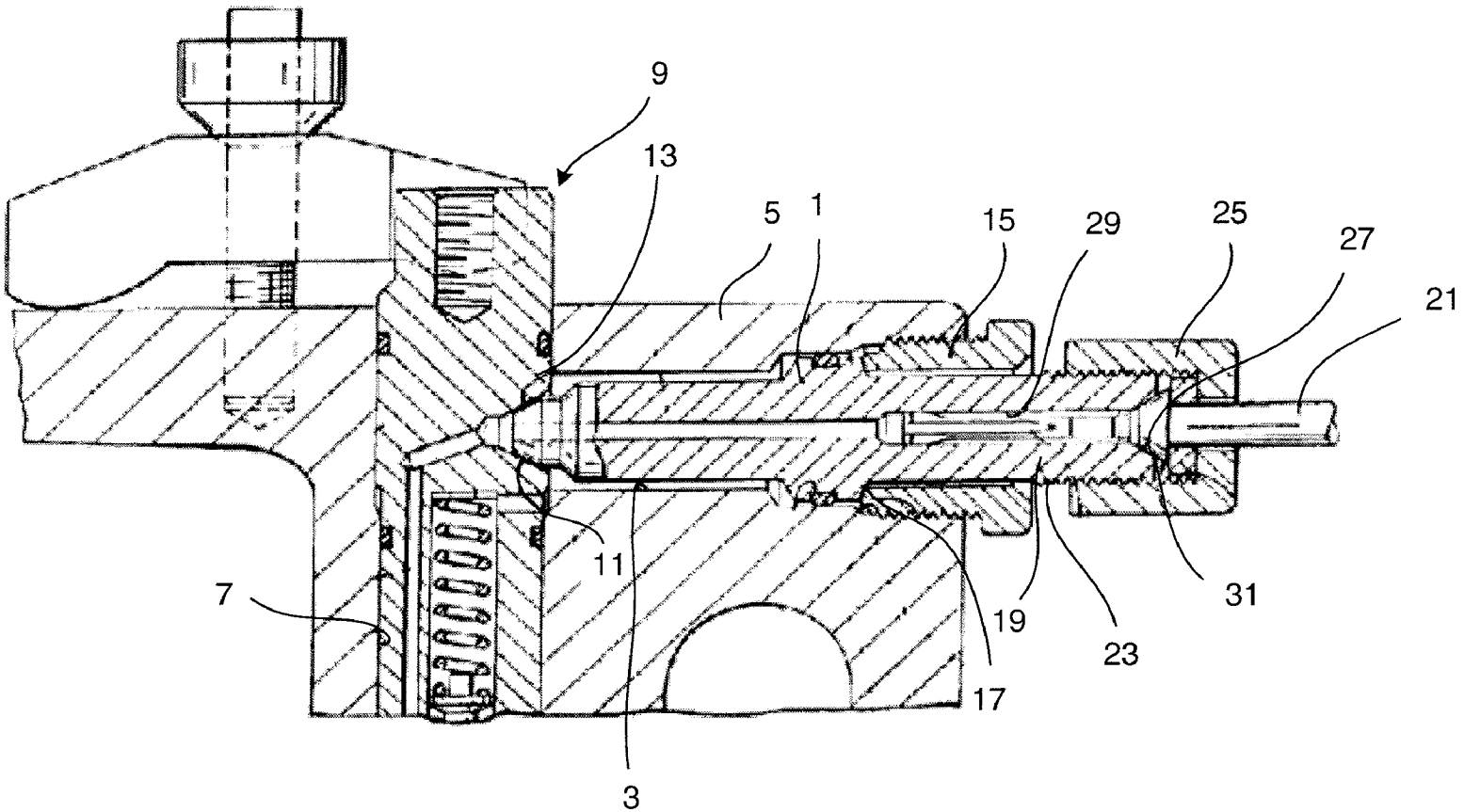
FIGURE 1 Prior Art
FIG. 1 shows a known fuel injection arrangement for an internal combustion engine.
Figure 2:
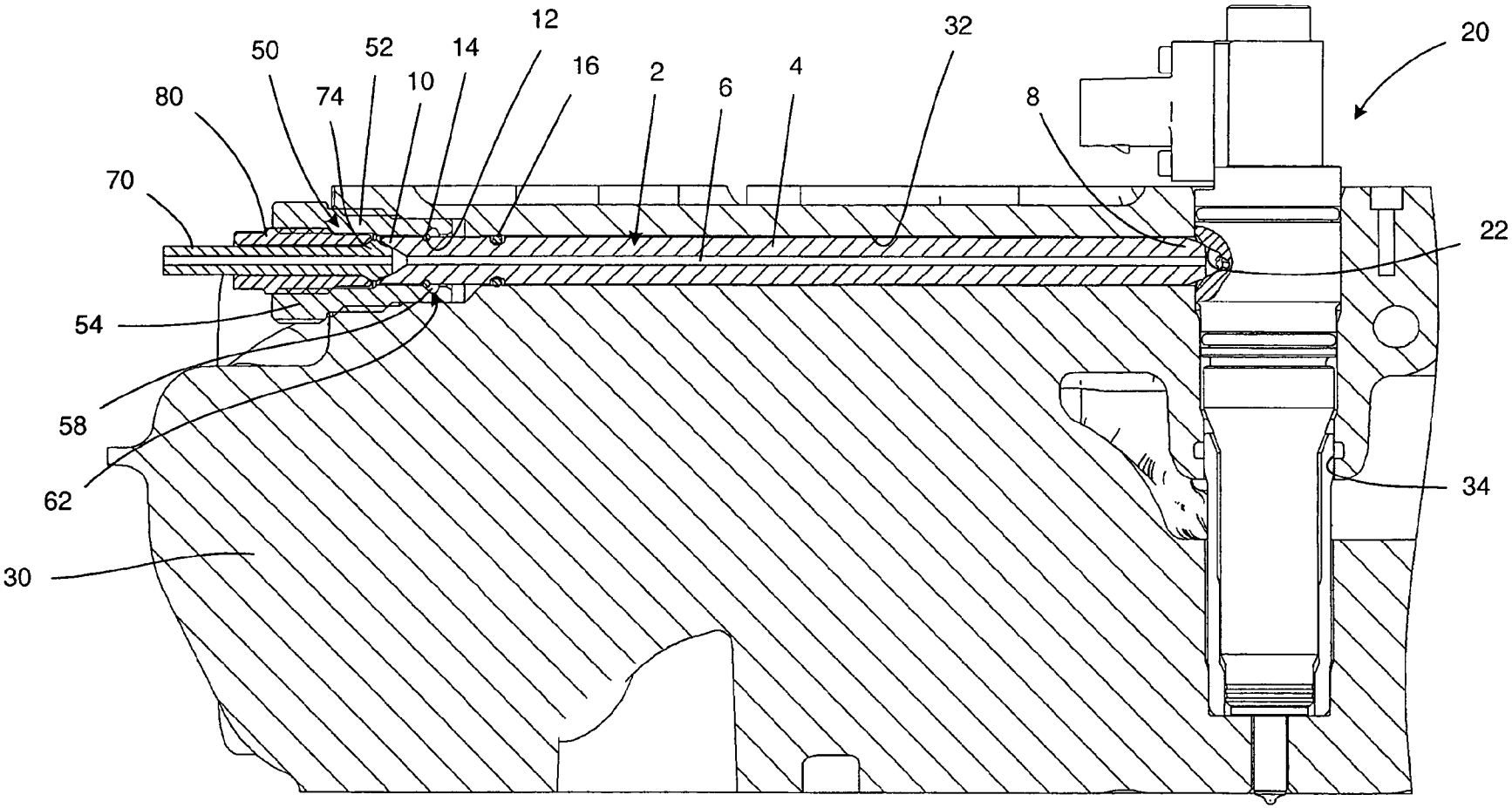
FIG. 2 is a sectional view illustrating a fuel supply line arrangement in accordance with an embodiment of the invention, in use.
Figure 3:
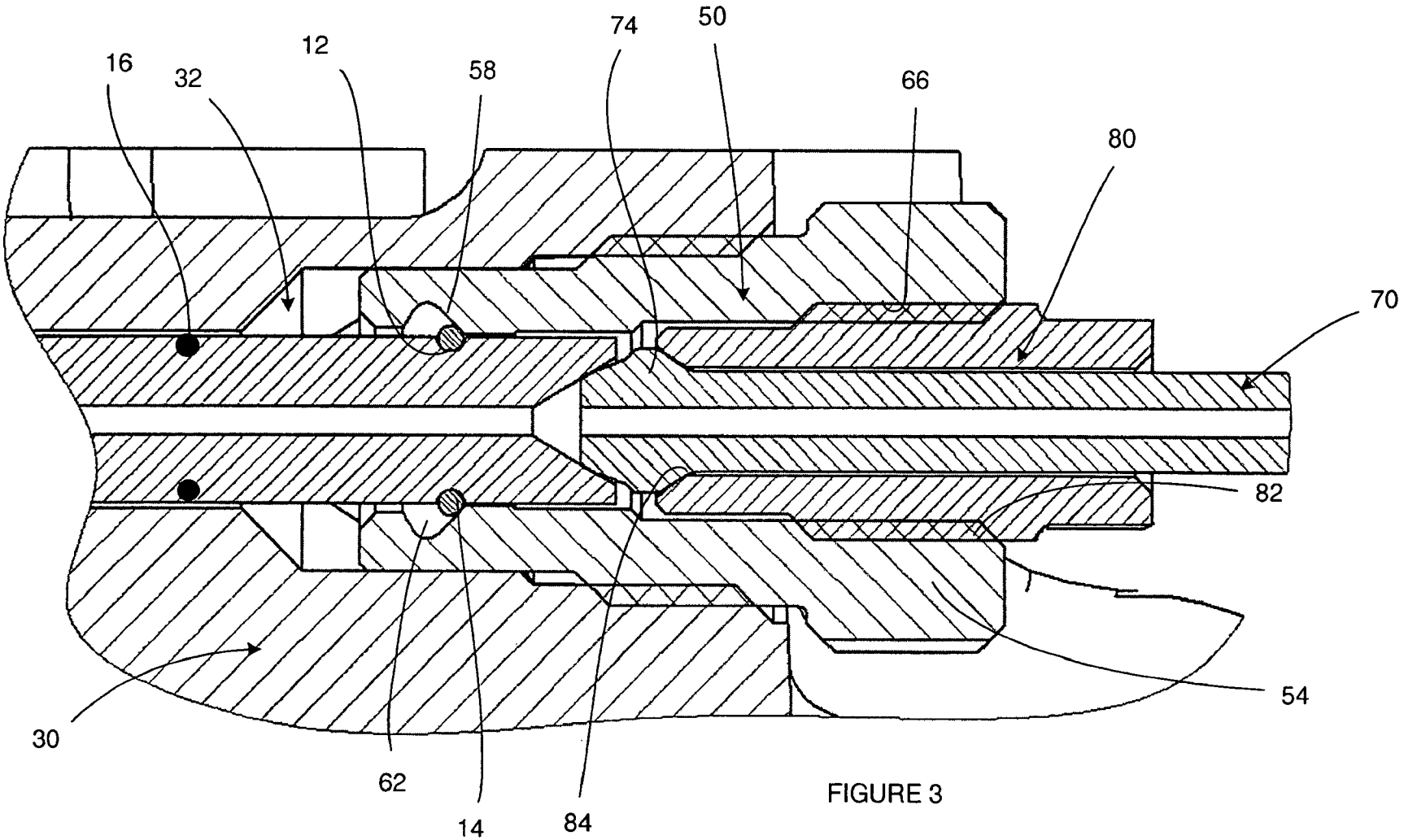
FIG. 3 is an enlarged view of the embodiment shown in FIG. 2.

With reference to FIGS. 2 and 3, a fuel lance 2 for use in connecting a supply of fuel from a high-pressure fuel pipe 70 to a fuel injector 20 is located within a passage 32 (which may be a bore) formed in a cylinder head 30. The injector 20 is housed within a bore 34 in the cylinder head, which intersects with the fuel supply passage 32 (approximately at 90°). The injector 20 is of the type which is provided with a seating surface 22 formed in a side thereof at approximately the height of intersection between the bore 34 and the passage 32, so that it is accessible from the passage 32, in use, so that fuel can be supplied from the fuel pipe 70 to the injector 20.

The fuel lance 2 comprises a tubular member 4 of approximately constant external diameter and an axial bore 6 therethrough, which is suitable for the transfer of fuel at high pressure. The constant diameter of the fuel lance 2 provides an advantage that it can be readily manufactured from tubing, such as a thick-walled pressure tube. The fuel lance 2 has a first (distal) end 8 that is shaped for engagement with the seating surface 22 of the injector 20, and a second (proximal) end 10 that is shaped for cooperation with a connection arrangement 40. As depicted, in this embodiment the fuel lance 2 has an overall length that is shorter than the length of the passage 32 in the cylinder head, so that it is entirely received within the cylinder head 30 and does not protrude into the engine space. The first end 8 of the fuel lance has a male frusto-conical or part-spherical seating surface to engage with a female frusto-conical seating surface 22 on the side of the injector 20. An annular seal member 16 in the form of a resilient rubber ring is located in an external circumferential groove in the lance 2. The seal member 16 cooperates with the internal wall of the passage 32 to form a substantially fluid tight seal between the fuel lance 2 and the passage 32 of the cylinder head 30.

An inlet adapter 50 is located partially within an end of the passage 32, the inlet adapter 50 including a distal (or first) region 52 shaped for receiving the second end 10 of the fuel lance 2, and a proximal (or second) region 54 shaped for receiving the high-pressure fuel pipe 70. The distal region 52 of the inlet adapter 50 is provided with an opening 56 (which may be a bore having an aperture), within which the second end 10 of the lance 2 is located. This arrangement can provide a number of advantages, for example, in assembly and use, as will become apparent.

An annular groove 62 is formed in the (inner) wall of the opening 56 in the distal region 52 of the inlet adapter 50. The annular groove 62 is shaped such that on assembly of the fuel supply line arrangement, an axial load is passed from the inlet adapter 50 along the length of the lance 2 to the fuel injector 20; and on disassembly, the fuel lance 2 is releasably retained in the opening 56 of the inlet adapter 50, so that it can be conveniently removed from the passage 32. To this end, the fuel lance 2 is further provided with an external (outer) circumferential groove 12, in which is received a thrust clip 14 for engagement with a conical surface 58 which comprises the distal facing wall of the groove 62. It will be appreciated that in this embodiment the external circumference of the fuel lance (2) is not constant in the region of the circumferential groove (12), however, the fuel lance maintains a substantially constant external diameter, i.e. the external diameter is constant over substantially (e.g. over 95%), of the length of the fuel lance. Conveniently, the trust clip may be a sprung metal thrust clip of circular cross section. However, it should be appreciated that the thrust clip may take any suitable form. In order to assist assembly, the opening 56 has a region of slightly increased internal diameter between the groove 62 and the distal end of the distal region 52, to enable the second end 10 of the lance 2, including the slightly protruding thrust clip 14, to be readily inserted into the opening 56. The region of the opening 56 proximal to the groove 62 has an internal diameter that more closely matches the outer circumference of the fuel lance 2 to restrict radial movement of the lance 2 within the inlet adapter 50. Conveniently, as in the embodiment depicted, the proximal facing surface of the groove 62 acts as a lip (or hook) when the inlet adapter 50 is removed from the passage 32, to retain the thrust clip 14 of the fuel lance 2 within the groove 62. Thus, it is convenient for the aperture of the opening 56 to be of smaller diameter than the external diameter of the thrust clip, but it is suitably not a tight fit with the external diameter of the fuel lance.

The inlet adapter 50 includes an attachment system for engagement with an attachment system provided on the cylinder head 30. In the embodiment depicted, the attachment system is in the form of an externally screw-threaded region 92 provided on the inlet adapter 50, which is arranged to cooperate with screw threads formed in the end region of the passage 32 of the cylinder head 30.

In the embodiment depicted, the second end 10 of the fuel lance 2 is provided with a female frusto-conical or part-spherical seating surface for engagement with a male frusto-conical end 74 of the fuel pipe 70. In order that the frusto-conical end 74 of the fuel pipe 70 can cooperate with the second end 10 of the fuel lance 2, the proximal region 54 of the inlet adapter is provided with a bore 64, co-axial with the opening 56, into which the fuel pipe 70 and a pipe nut 80 are received. The pipe nut 80 is arranged to surround a portion of the fuel pipe 70 behind the end 74, and includes a thrust surface 84, in use, for exerting an axial load in the direction of the end 74 of the fuel pipe 70 when the pipe nut 80 is received within the inlet adapter 50.

For mounting the pipe nut 80 within the inlet adapter 50, the bore 64 is provided with an internal (female) screw-thread 66 over at least a part of the length of the bore for engagement with an external (male) screw-threaded region 82 over a region of the pipe nut 80. The screw-threaded regions 66, 82 are arranged such that when the pipe nut 80 and inlet adapter 50 are correctly engaged a substantially fluid tight seal is created between the end 74 of the fuel pipe 70 and second end 10 of the fuel lance 2, and the axially extending bore 6 of the lance 2 aligns with the fuel passage 72 of the fuel pipe 70.

Figure 4:
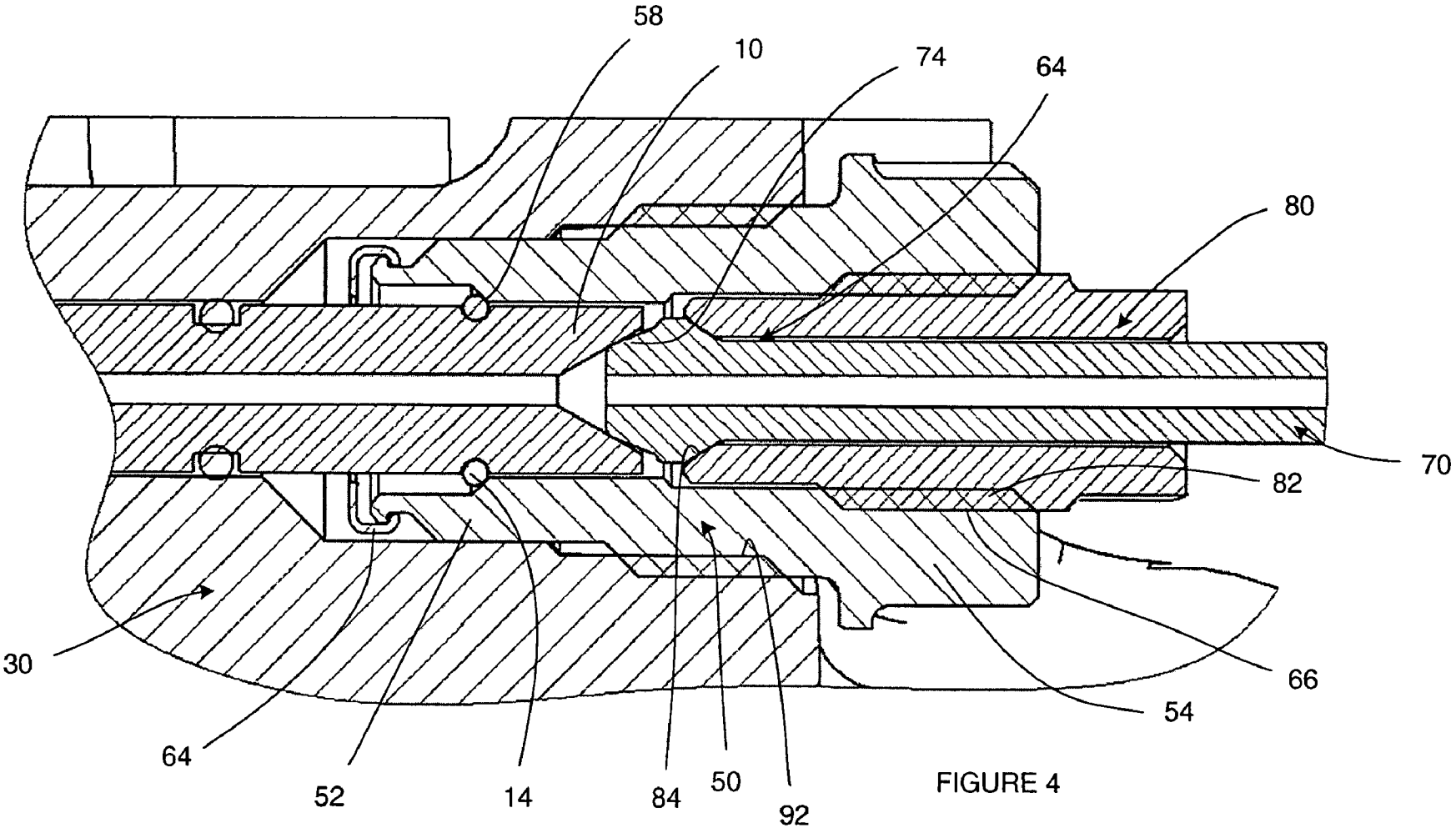
FIG. 4 is an enlarged view of an alternative embodiment to that shown in FIG. 2.

FIG. 4 shows an alternative embodiment of the fuel lance 2 of FIGS. 2 and 3, wherein the proximal facing surface of the groove 62 has been replaced with a hook member in the form of an extraction clip 64, and the distal region of the inlet adapter 50 is adapted for receiving (attaching) the extraction clip 62. In this embodiment, the extraction clip 62 can be attached to the inlet adapter 50 after the second end 10 of the lance 2 has been located in the opening 56, and/or the extraction clip 62 may be resiliently deformable to allow the thrust clip 14 to be pushed past it and into the opening 56.

To assemble the fuel supply line arrangement shown in FIGS. 2 to 4, the second end 10 of the lance 2 is inserted into the opening 56 in the distal region 52 of the inlet adapter 50 until the thrust clip 14 locates in the annular groove 62. Thus, the fuel lance 2 is loosely secured to the inlet adapter 50. Once the injector 20 has been located within the cylinder head 30, the fuel lance assembly comprising the lance 2 and inlet adapter 50 is inserted into the passage 32 of the cylinder head 30, and the first end 8 of the fuel lance 2 is located to engage the seating surface 22. The inlet adapter 50 is rotated relative to the cylinder head 30 in order to engage the male screw-thread 92 of the inlet adapter 50 with the female screw-thread in the passage 32 of the cylinder head 30. As the distal region 52 of the inlet adapter 50 thus inserts into the passage 32, an axial compressive load is applied and transmitted from the conical surface 58 of the inlet adapter 50, through the thrust clip 14 and along the length to the lance 2, to form a substantially fluid tight seal between the first end 8 of the lance 2 and the seating 22 of the fuel injector 20. Beneficially, the first end 8 has a part-spherical surface to help compensate for any misalignment between the lance 2 and the seating 22, which may be caused through machining variations.

To connect the fuel pipe 70 to the lance 2, the pipe nut 80 having the fuel pipe 70 received therethrough is secured within the bore 64 in the proximal region 54 of the inlet adapter 50. The pipe nut 80 is secured to the inlet adapter 50 by locating it within the opening 64 and rotating it relative to the inlet adapter 50 in order to engage the mutual screw-threaded regions 66, 82. Once fully engaged, an axial compressive load is exerted from the thrust surface 84 (which is conveniently of frusto-conical form) of the pipe nut 80 through the end 74 of the pipe 70, such that the male frusto-conical surface of the end 74 forms a substantially fluid tight seal with the female frusto-conical or part-spherical surface of the second end 10 of the fuel lance 2.

Figure 5:
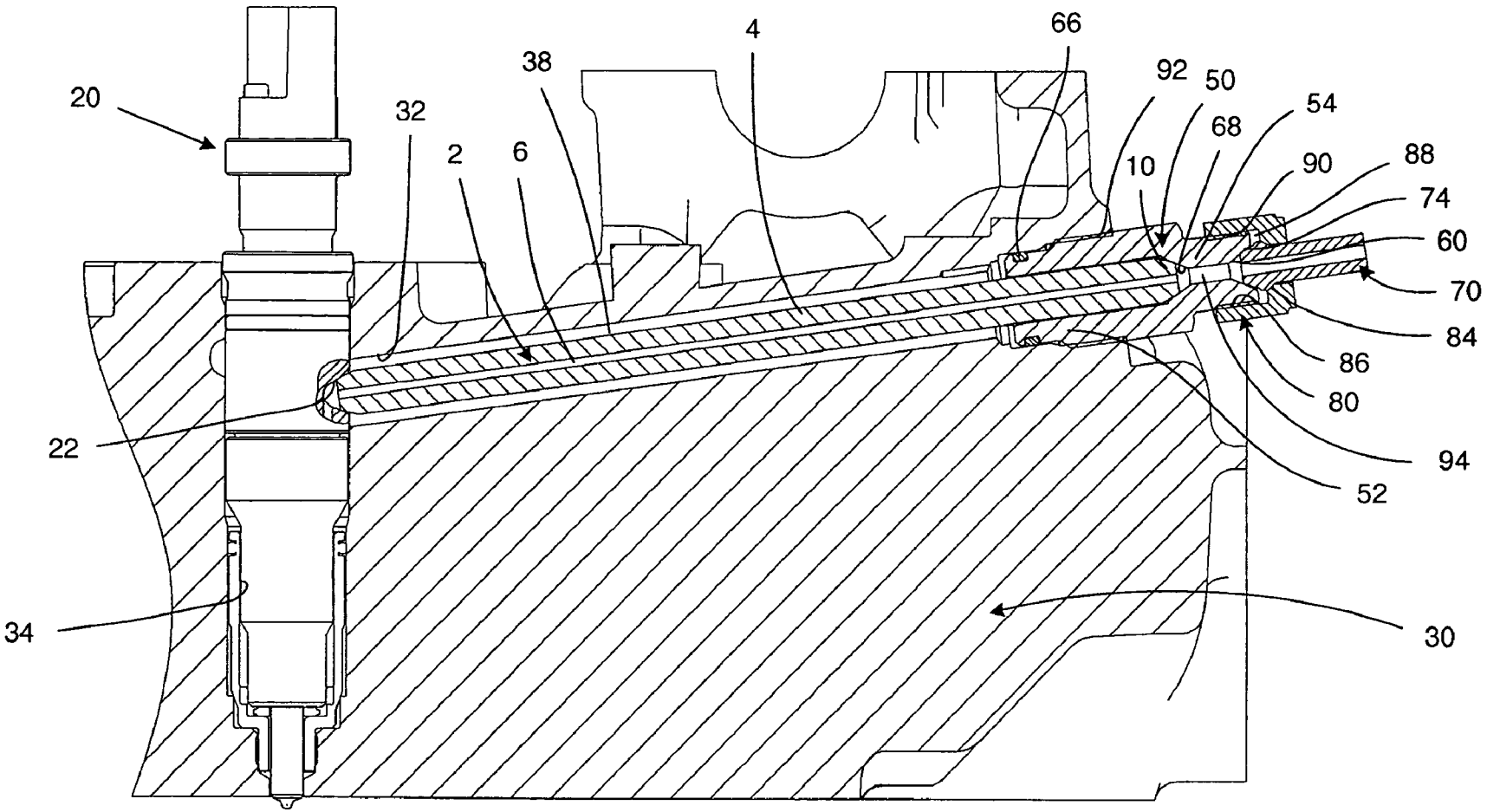
FIG. 5 is a sectional view illustrating a fuel supply line arrangement in accordance with an alternative embodiment of the invention, in use.

FIG. 5 shows another embodiment of the fuel supply line arrangement of FIG. 2 to 4 and like reference numerals are used for like parts. In this embodiment, instead of the second end 10 of the lance 2 having a female frusto-conical or part-spherical surface for directly cooperating with the end 74 of the fuel pipe 70, the second end 10 of the lance 2 is provided with a male frusto-conical or part-spherical surface. To engage the male second end 10 of the fuel lance, the inlet adapter 50 is provided with a female frusto-conical or part-spherical surface 68. The surface 68 is located at the proximal end (i.e. the base) of the opening 56 in the distal region 52 of the inlet adapter 50, and it is arranged to engage the second end 10 of the lance 2 when it is fully inserted into the opening 56.

The proximal region 54 of the inlet adapter 50 is provided with a female frusto-conical or part-spherical surface 60 for cooperating with the male frusto-conical end 74 of the fuel pipe 70, when the fuel pipe is attached to the inlet adapter 50 by way of the pipe nut 80.

The inlet adapter 50 is further provided with an axial bore 94 to provide a fluid communication path between the opening 56 in the distal region 52 of the inlet adapter 50 and the bore 64 in the proximal region 54 of the inlet adapter 50, so that fuel can flow from the fuel pipe 70 to the fuel lance 2.

Thus, in this embodiment the fuel lance 2 does not pass fully through the inlet adapter 50, nor does the fuel lance 2 directly contact the fuel pipe 70. Instead, the inlet adapter 50 provides surfaces 60, 68 for engaging the fuel pipe 70 and the fuel lance 2, respectively. In this way, the surfaces and material of the inlet adapter can be specifically selected for optimal engagement with the other components in the fuel line.

The pipe nut 80 of this embodiment is provided with a through-bore to receive the fuel pipe 70 and an enlarged bore 88 arranged to receive at least a length of the proximal region 54 of the inlet adapter 50. The bore 88 is provided with an engagement system, in the form of an internal (female) screw-thread 86 along a length of the bore 88 (conveniently over substantially the entire length of the bore), for engagement with an external (male) screw-thread 90 provided over at least a part of the outer surface of the proximal region 54 of the inlet adapter 50. The inlet adapter 50 and pipe nut 80 are arranged such that, in use, engagement of the pipe nut 80 with the inlet adapter 50 creates a substantially fluid tight seal between the male frusto-conical end 74 of the fuel pipe 70 and the female frusto-conical or part-spherical surface 60 of the inlet adapter 50.

In the embodiment of FIG. 5, the outer surface of the fuel lance 2 together with the passage 32 defines an annular chamber 38 which, in use, may be arranged to communicate with a low pressure drain chamber (not shown), which may be located between the injector 20 and the bore 34 containing the injector 20 with which drain passages of the injector 20 communicate. Conveniently, the cylinder head 30 may also include a passage (not shown) which communicates with the chamber 38, and permits fuel at low pressure to escape from the injector 20 to a low pressure fuel reservoir. Distally (inwardly) of the screw-threaded region 92 of the inlet adapter 50, the inlet adapter 50 includes an annular recess which locates an annular seal member 66 (e.g. in the form or a resilient rubber ring) arranged to form a substantially fluid tight seal between the inlet adapter 50 and the wall of the cylinder head 30 defining the passage 32. It will be appreciated that the provision of the seal member 66 prevents or restricts fuel from escaping from the chamber 38 through the end of the passage 32. In this embodiment, the fuel lance 2 is not provided with an annular seal member 16, although it should be appreciated that in alternative embodiments the seal members 16 and 66 could be used in combination or separately, as desired.

In a slight variation to the embodiments of FIGS. 2 to 4, to assemble the fuel supply line arrangement of FIG. 5, the pipe nut 80 having a bore 88 with an internal screw-thread 86 and the fuel pipe 70 received therethrough, is first placed over the proximal region 54 of the inlet adapter 50, and then rotated relative to the inlet adapter 50 to engage the internal screw-thread 86 of the pipe nut 80 with the external screw-thread 90 of the inlet adapter 50. When the pipe nut 80 and inlet adapter 50 are fully engaged, an axial compressive load is exerted from the thrust surface 84 (conveniently of frusto-conical form) of the pipe nut 80 through the end 74 of the pipe 70, such that the male frusto-conical surface of the end 74 forms a substantially fluid tight seal against the female frusto-conical or part-spherical surface 60 of the inlet adapter 50.

It will be understood that while the annular chamber 38 is clearly visible in the embodiment of FIG. 5, in another embodiment, the fuel lance 2 and passage 32 may be closely fitting, such that they are arranged to minimize the volume of the annular chamber 38 (as indicated in FIGS. 2 to 4). However, in any embodiment, it is difficult to eliminate entirely the annular chamber 38 and so the annular chamber 38 may equally be present in the embodiments of FIGS. 2 to 4. Similarly, it should be appreciated that the inlet adapter 50 shown in FIGS. 2 to 4 may be adapted to include an annular seal member 66, such as that depicted in FIG. 5.

It will also be noted that while in FIG. 2 the passage 32 for receiving the lance 2 within the cylinder head 30 is arranged at approximately 90° to the bore 34 housing the fuel injector 20; in the embodiment depicted in FIG. 5, the passage 32 is not at 90° to the bore 34. It should be appreciated that the passage 32 and bore 34 can, in any of the embodiments, be arranged at any suitable angle.

Figure 6:
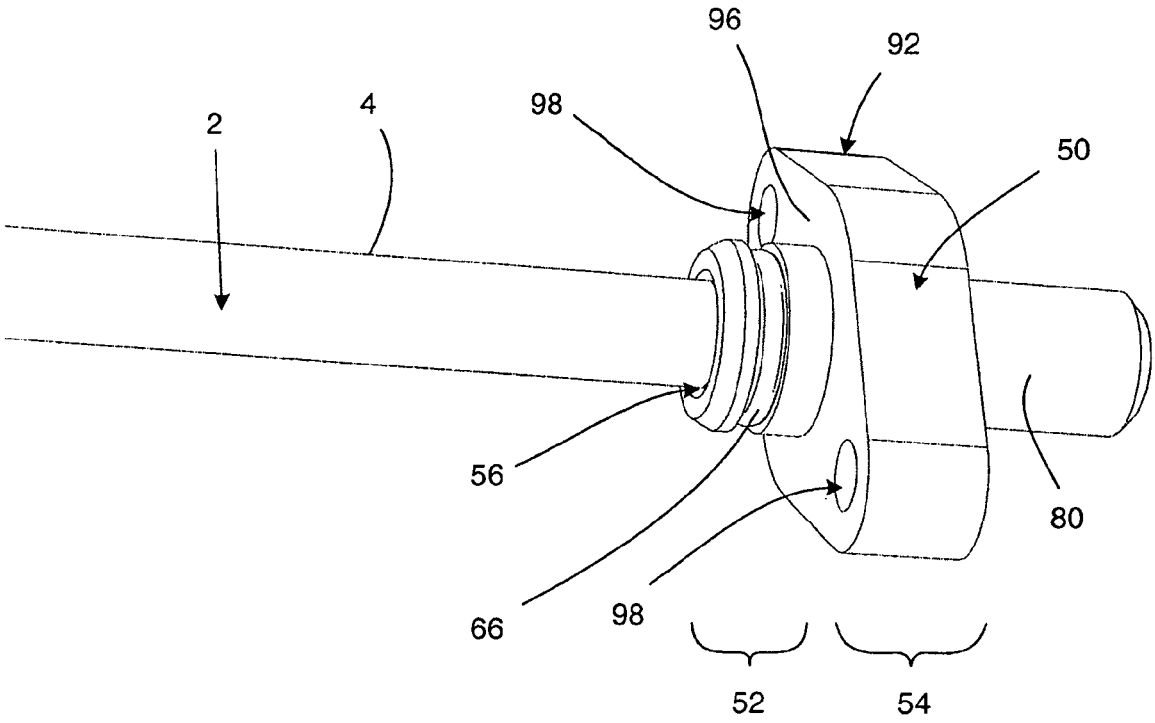
FIG. 6, is a three-dimensional representation of a fuel lance assembly in accordance with one embodiment of the invention.

An embodiment of a fuel lance arrangement is shown in FIG. 6. The fuel lance arrangement comprises a fuel lance 2 having a tubular member 4 of constant external diameter. A second end 10 (not visible) of the lance 2 is located within the opening 56 in the distal region 52 of the inlet adapter 50. The embodiment depicted further includes a pipe nut 80 that is engaged with the proximal region 54 of the inlet adapter. In this embodiment, the inlet adapter 50 further comprises a radially extending flange 92, the flange 92 being provided with two axial through-bores 98. Each one of the axial through-bores 98 is arranged to receive, in use, a fixing member, for example, in the form of a screw or bolt, for securing the inlet adapter 50 to the cylinder head 30. The distal region 52 of the inlet adapter 50 is provided with an annular seal member 66, in the form of a resilient rubber ring, located in a circumferential groove on the external surface of the inlet adapter 50.

It should be appreciated that the flange 92 can extend radially from the inlet adapter to take any convenient shape, for example, a circle, oval, square, rectangle, or such as that depicted. Any number of axial through-bores for receiving fixing members may be provided, such as 1, 2, 3, 4 or more. Conveniently, 2 or 3 fixing members are used.

Figure 7:
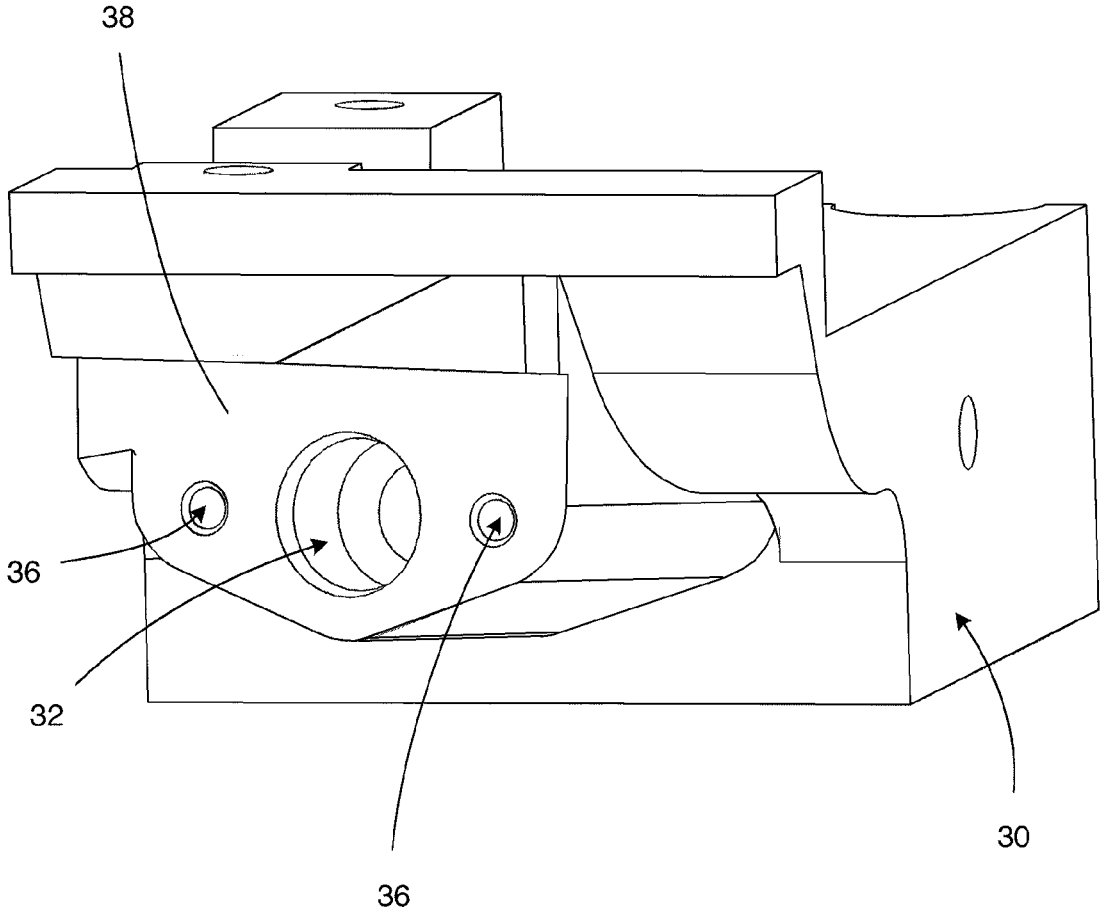
FIG. 7 is a three-dimensional representation of a cylinder head suitable for use with the fuel lance assembly shown in FIG. 6.

FIG. 7 depicts a cylinder head 30 suitable for use with the fuel lance arrangement of FIG. 6. The passage 32 of the cylinder head 30 is exposed at a side face 38 of the cylinder head 30 for insertion of the fuel lance arrangement. The cylinder head 30 is further provided with two fixing member holes 36, suitably in the form of screw-threaded bores, arranged on opposing sides of the passage 32. The fixing member holes 36 are arranged to be co-axial with the axial through-bores 98 of the inlet adapter 50 when the fuel lance arrangement is correctly inserted into the passage 32.

To assemble the fuel supply arrangement of this embodiment, the first end 8 of the lance 2 of the fuel lance assembly (or arrangement) is inserted into the passage 32 of the cylinder 30. The fuel lance assembly is pushed into the passage 32 until the distal region 52 of the inlet adapter 50 is also received within the passage 32. A fixing member, suitably in the form of a bolt (not shown), is inserted into each of the axial through-bores 98 from the proximal side (102, not shown in FIG. 7) of the flange 92 and out through the distal side 96 to locate into each screw-threaded bore 36 in the cylinder head 30. The bolts are then tightened into the fixing member holes to secure the fuel lance assembly within the passage 32. Advantageously in this embodiment, it is not necessary to rotate the inlet adapter 50 relative to the passage 32 of the cylinder head 30. Thus, there is reduced risk of particle formation during assembly of the fuel supply line arrangement, and no need to provide an anti-rotation system to inhibit or prevent rotational movement of the lance 2 within the passage 32 as the inlet adapter 50 is engaged with the cylinder head 30. Another advantage is apparent when the fuel lance assembly is arranged such that when it is fully inserted (and fixed using the fixing members) within the passage 32, the distal surface 96 of the flange 92 is spaced from the opposing wall (or surface) 38 of the cylinder head. In this way, the axial load generated by tightening of the fixing members between the flange 92 and the cylinder head 30 is transmitted axially along the fuel lance 2 and not from the flange 92 into the cylinder head 30.

The inlet adapter 50 of the alternative embodiment depicted in FIG. 6 may be arranged to cooperate with the fuel lance 2 and/or fuel pipe 70 in any suitable manner, such as by the modes depicted in FIGS. 3 to 5.

Figure 8A:
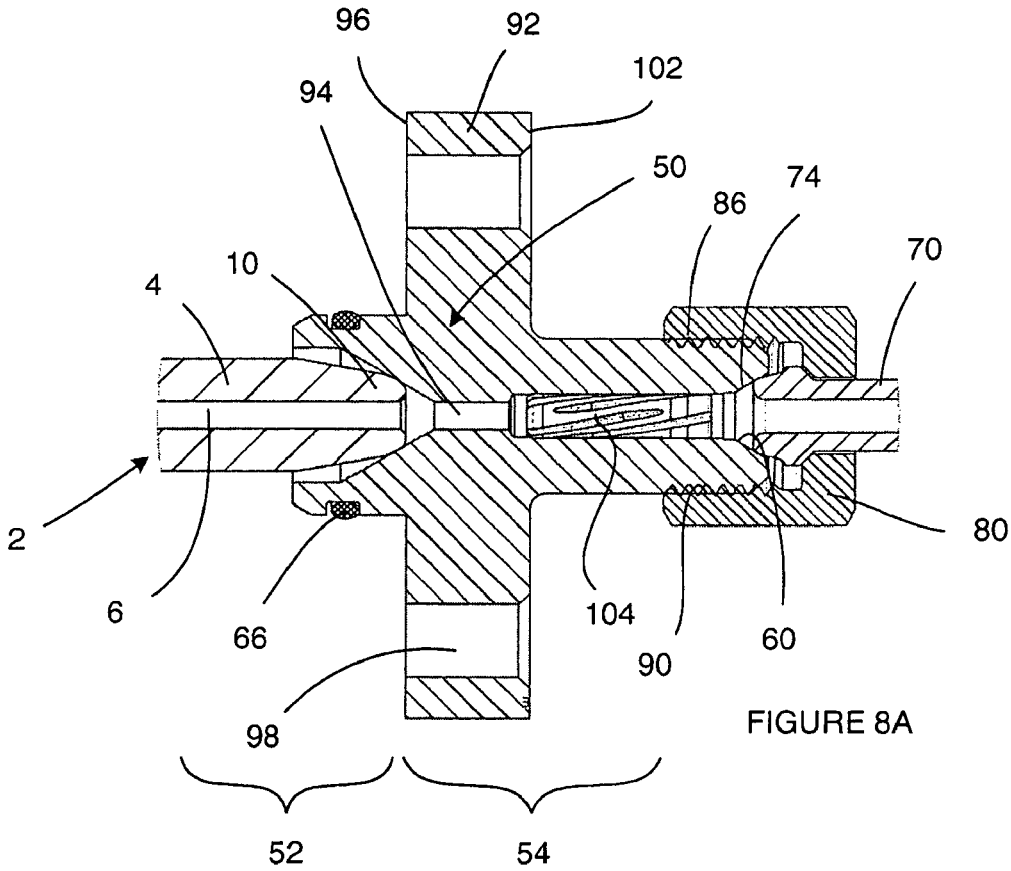
FIG. 8 is a schematic representation of a first (A) and a second (B) embodiment of the fuel lance assembly shown in FIG. 6.

By way of example, in the embodiment of FIG. 8A, the distal region 52 of the inlet adapter 50 is provided with a female frusto-conical or part-spherical surface 68 for engagement with a male frusto-conical or part-spherical surface formed at the second end 10 of the fuel lance 2. As in the alternative embodiment of FIG. 5, the surface 68 is located at the proximal end of the opening 56 in the distal region 52 of the inlet adapter 50. The proximal region 54 of the inlet adapter 50 is provided with a female frusto-conical or part-spherical surface 60 for cooperating with the male frusto-conical end 74 of the fuel pipe 70 when the fuel pipe is attached to the inlet adapter 50 by way of the pipe nut 80. The pipe nut 80 is engaged with the inlet adapter 50 in the manner already described in relation to FIG. 5. The inlet adapter 50 is further provided with an axial bore 94 to provide a fluid communication path between the opening 56 in the distal region 52 of the inlet adapter 50 and the bore 64 in the proximal region 54 of the inlet adapter 50. In the embodiment depicted, the inlet adapter is further provided with a particulate filter in the form of an edge filter 104, to remove particulate matter from the fuel passing therethrough.

Figure 8B:
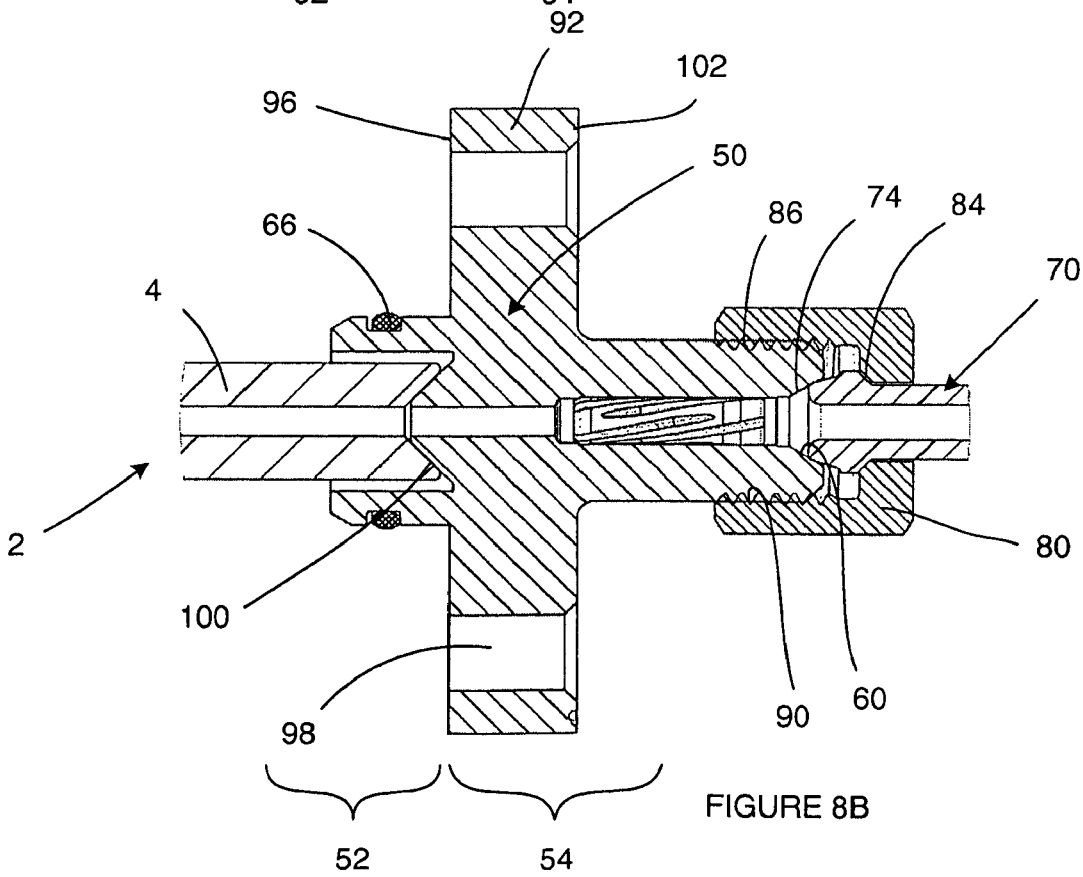

FIG. 8B depicts an alternative inlet adapter 50, which is adapted for engagement between a female frusto-conical or part-spherical seating surface at the second end 10 of the lance 2 and a male frusto-conical end 74 of a fuel pipe 70. In this embodiment, the proximal end of the opening 56 in the inlet adapter 50 has a male frusto-conical or part-spherical surface 100, for engagement with the second end 10 of the lance 2 when it is fully inserted into the opening 56. The proximal region 54 of the inlet adapter 50 is conveniently arranged as described in FIG. 8A for engagement with the male frusto-conical end 74 of the fuel pipe 70. As the second end 10 of the lance 2 is not directly engaged with the end 74 of the fuel pipe 70, the inlet adapter 50 is provided with an axial bore 94 (as described in the embodiment of FIG. 8A) to provide a co-axial passage for fluid communication between the fuel pipe 70 and the bore 6 of the fuel lance 2. This provides the beneficial option of including an edge filter 104 within the fuel flow path through the inlet adapter. The person of skill in the art will appreciate that the arrangement of the inlet adapted described with reference to FIG. 8B may be readily adapted to replace the arrangement described with reference to FIGS. 2 to 4, and vice versa, such that the embodiment of FIG. 8B may be adapted to allow a direct cooperation between the fuel lance 2 and the fuel pipe 70.

In any of the embodiments described hereinbefore, the fuel lance 2 and the inlet adapter 50 may be constructed from different materials or may be heat-treated in different manners to be of different strengths. As a result, plastic deformation of one of these components may occur, improving the seals that must be formed in order to avoid leakage of fuel. For example, the fuel lance 2 may be arranged to deform at both the point of engagement between the first end 8 and the seating surface 22, and the point of engagement between the lance 2 and the inlet adapter 50 or the end 74 of the pipe 70, dependent on the arrangement. As the fuel lance 2 is of relatively simple form and relatively cheap to manufacture, it may be intended for replacement upon servicing.

It will be apparent that the arrangements illustrated in FIGS. 2 to 7 may be modified, and that such modifications may fall within the scope of the invention. For example, the embodiments that comprise the thrust clip 14 may be adapted by removing the thrust clip 14 and its circumferential recess 12. Likewise, those embodiment that are depicted without a thrust clip 14 may be modified by adding a circumferential recess 12 and thrust clip 14, as desired. Further, the inlet adapter 50 of any embodiment may be provided with either a groove 62 within the opening 56 (as previously described) to retain the fuel lance 2 when it is removed from the passage 32 of the cylinder head; and any embodiment may alternatively be provided with an extraction clip 64 as previously described.

In some embodiments, the fuel lance 2 may be provided with an anti-rotation system, for example, in the form of a recess arranged to align, in use, with a recess formed in the passage 32, a steel bearing or similar member being located within these recesses to restrict or prevent angular movement of the fuel lance 2 within the passage 32.

As already noted, although in some embodiments the passage 32 extends substantially perpendicularly to the axis of the injector 20 within the bore 34, it will be appreciated that this need not be the case and that the invention is also applicable to arrangements wherein the passage 32 and the axis of the injector 20 subtend an angle of other than 90°.

Suitably, the fuel lance 2 and/or the inlet adapter 50 is provided with an annular seal member 16, 66 (respectively), arranged to form a substantially fluid tight seal between the fuel lance 2 and/or the inlet adapter 50 and the wall of the cylinder head 30 defining the passage 32, to prevent or restrict fuel from escaping through the end of the passage 32. It will be appreciated that the exact location of the seal member, when used, is not critical provided that it performs its intended function.

Although particular embodiments of the invention have been disclosed herein in detail, this has been done by way of example and for the purposes of illustration only. The aforementioned embodiments are not intended to be limiting with respect to the scope of the appended claims, which follow. Thus, it is contemplated that various substitutions, alterations, and modifications may be made to the various components of the fuel injectors and injection nozzles without departing from the spirit and scope of the invention as defined by the claims.

The invention claimed is:

1. A fuel lance for use in supplying fuel to a fuel injector and arranged to be received, in use, within a passage provided in an engine cylinder head, the fuel lance comprising a tubular member of constant external diameter;

wherein the length of the fuel lance is shorter than the length of the passage of the cylinder head such that, in use, the fuel lance can be fully received within the passage;

the fuel lance being shaped, at a first end thereof, for cooperation with a seating surface of the fuel injector and at a second end for cooperation with a connection arrangement comprising an inlet adapter;

the fuel lance having a bore therethrough to define a fluid flow path between the fuel injector and the connection arrangement;

wherein the fuel lance is provided with an external circumferential groove to receive a thrust clip for engagement with a surface of the inlet adapter, such that when the fuel lance is secured within the passage of the cylinder head by the inlet adapter, the surface of the inlet adapter exerts an axial load through the thrust clip along the length of the fuel lance to provide a sealing pressure between the first end of the fuel lance and the seating surface of the fuel injector.

2. The fuel lance of claim 1, wherein the second end of the fuel lance is arranged to be receivable within an opening in the inlet adapter.

3. The fuel lance of claim 1, wherein the second end of the fuel lance is provided with a region of part-spherical form permitting a degree of articulation between the inlet adapter and the fuel lance.

4. The fuel lance of claim 1, wherein the fuel lance carries an annular seal member arranged in use to form a substantially fluid tight seal between the fuel lance and the passage in the cylinder head.

5. The fuel lance of claim 1, further comprising a filter member located within the bore of the fuel lance.

6. A fuel lance assembly for an engine comprising a fuel injector to be located within a bore of an engine cylinder head; the fuel lance assembly comprising:

an inlet adapter; and a fuel lance for use in supplying fuel to the fuel injector and arranged to be received, in use, within a passage provided in an engine cylinder head, the fuel lance comprising a tubular member of constant external diameter;

wherein the length of the fuel lance is shorter than the length of the passage of the cylinder head such that, in use, the fuel lance can be fully received within the passage;

the fuel lance being shaped, at a first end thereof, for cooperation with a seating surface of the fuel injector and at a second end for cooperation with a connection arrangement comprising the inlet adapter;

the fuel lance having a bore therethrough to define a fluid flow path between the fuel injector and the connection arrangement;

wherein the fuel lance is provided with an external circumferential groove to receive a thrust clip for engagement with a surface of the inlet adapter, such that when the fuel lance is secured within the passage of the cylinder head by the inlet adapter, the surface of the inlet adapter exerts an axial load through the thrust clip along the length of the fuel lance to provide a sealing pressure between the first end of the fuel lance and the seating surface of the fuel injector;

wherein the inlet adapter is adapted to be at least in part receivable within the passage of the cylinder head and is provided with an attachment system for engaging a compatible attachment system of the cylinder head, the inlet adapter further having a distal region provided with an opening being adapted to receive the second end of the fuel lance, and a proximal region for receiving a high pressure fuel pipe.

7. The fuel lance assembly of claim 6, wherein the inlet adapter is arranged to clamp the first end of the fuel lance to the seating surface of the fuel injector such that a substantially fluid tight seal is formed between the fuel lance and the fuel injector.

8. The fuel lance assembly of claim 6, wherein the wall of the opening of the inlet adapter is provided with an annular groove, and wherein the distal facing surface of the groove is shaped to provide a conical surface, in use, for engagement with the thrust clip of the fuel lance.

9. The fuel lance assembly of claim 8, wherein the opening of the inlet adapter has a stepped internal diameter, and wherein the internal diameter of the opening distal to the annular groove is of greater diameter than the internal diameter of the opening proximal to the groove.

10. The fuel lance assembly of claim 8, wherein, in use, the thrust clip of the fuel lance locates in the annular groove of the inlet adapter, and wherein the annular groove is shaped such that on disengaging the inlet adapter from the cylinder head the second end of the fuel lance is releasably retained in the opening.

11. The fuel lance assembly of claim 6, wherein the distal region of the inlet adapter is adapted to receive an extraction clip, in use, for releasably retaining the second end of the fuel lance in the opening when the inlet adapter is disengaged from the cylinder head.

12. The fuel lance assembly of claim 6, wherein the fuel lance carries an annular seal member arranged to form a substantially fluid tight seal between the fuel lance and the passage of the cylinder head; and/or wherein the inlet adapter carries an annular seal member arranged to form a substantially fluid tight seal between the inlet adapter and the cylinder head.

13. A fuel lance assembly for an engine comprising a fuel injector to be located within a bore of an engine cylinder head; the fuel lance assembly comprising:

a fuel lance to be received in a passage provided in the cylinder head and a connection arrangement comprising an inlet adapter for securing the fuel lance within the passage; wherein the fuel lance comprises a tubular member of constant external diameter, arranged to be received, in use, within the passage and having a first end being shaped for cooperation with a seating surface of the fuel injector of the engine, and a second end being shaped for cooperation with the inlet adapter, and being provided with a bore therethrough to define a fuel flow path between the first end and the second end of the fuel lance;

wherein the inlet adapter is provided with an attachment system for engaging a compatible attachment system of the cylinder head, and has a proximal region for receiving a high pressure fuel pipe, and wherein the inlet adapter has a distal region provided with an opening being adapted to receive the second end of the fuel lance.

14. The fuel lance assembly of claim 13, wherein the length of the fuel lance is shorter than the length of the passage of the cylinder head such that, in use, the fuel lance can be fully received within the passage of the cylinder head.

15. The fuel supply line arrangement of claim 13, wherein the proximal region of the inlet adapter is provided with a female frusto-conical or part-spherical surface for cooperating with a male frusto-conical end of the fuel pipe; and wherein the second end of the fuel lance is of male frusto-conical or part-spherical form, and the distal region of the inlet adapter is provided with a female frusto-conical or part-spherical surface at the proximal end of the opening for cooperating with the second end of the fuel lance.

16. The fuel lance assembly of claim 13, wherein the inlet adapter is arranged to clamp the first end of the fuel lance to the seating surface of the fuel injector such that a substantially fluid tight seal is formed between the fuel lance and the fuel injector.

17. The fuel lance assembly of claim 13, which further comprises a pipe nut for receiving a fuel pipe and arranged, in use, to engage the proximal region of the inlet adapter, such that a fuel flow path is established between the passage of the fuel pipe and the bore of the fuel lance.

18. The fuel lance assembly of claim 17, wherein the pipe nut is provided with a bore arranged to receive at least a length of the proximal region of the inlet adapter, at least a length of the bore being provided with a screw-thread, in use, to cooperate with a screw-thread provided over at least a part of the outer surface of the proximal region of the inlet adapter, such that engagement of the pipe nut with the inlet adapter creates a substantially fluid tight seal between the fuel pipe and the inlet adapter.

19. The fuel lance assembly of claim 13, wherein the attachment system of the inlet adapter comprises a screw-thread over at least a portion of the outer surface of the inlet adapter, in use, for engagement with an attachment system comprising an internal screw-thread over at least a length of the passage.

20. The fuel lance assembly of claim 13, wherein the attachment system of the inlet adapter and the cylinder head comprises a fixing member, such as a bolt or screw.

21. The fuel lance assembly of claim 20, wherein the inlet adapter is provided with a radially extending circumferential flange, the flange having at least one axial through bore for receiving a fixing member, in use, to be aligned with at least one fixing member hole provided in the cylinder head of the engine for attaching the inlet adapter to the cylinder head by use of the at least one fixing member.

22. The fuel lance assembly of claim 21, wherein, in use, when the inlet adapter is correctly received within the passage of the cylinder head, the flange of the inlet adapter is axially spaced from the cylinder head, such that when the fuel lance is secured within the passage of the cylinder head by means of the at least one fixing member the axial load between the at least one fixing member and the flange of the inlet adapter is transmitted from the inlet adapter to the fuel lance to provide a sealing pressure between the first end of the fuel lance and the seating surface of the fuel injector.

23. The fuel lance assembly of claim 13, wherein the fuel lance carries an annular seal member arranged to form a substantially fluid tight seal between the fuel lance and the passage of the cylinder head; and/or wherein the inlet adapter carries an annular seal member arranged to form a substantially fluid tight seal between the inlet adapter and the cylinder head.

24. The fuel lance assembly of claim 13, wherein the fuel lance is formed from a plastics material, and wherein the frusto-conical or part-spherical surfaces at the first and second ends of the fuel lance are heat treated to provide a hard surface to minimize plastic deformation.

25. The fuel lance assembly of claim 13, wherein the distal region of the inlet adapter comprises an external guide to restrict angular movement within the passage of the cylinder head.

26. The fuel lance assembly of claim 13, wherein the inlet adapter is provided with an integrated filter member arranged within the fuel flow path between the bore of the fuel lance and the fuel pipe.

27. A fuel supply line arrangement for an engine comprising;

a fuel injector to be located within a bore of an engine cylinder head;

a fuel lance for use in supplying fuel to the fuel injector and arranged to be received, in use, within a passage provided in the engine cylinder head; and and a connection arrangement comprising an inlet adapter for securing the fuel lance within the passage;

wherein the fuel lance comprises a tubular member of constant external diameter;

wherein the length of the fuel lance is shorter than the length of the passage of the cylinder head such that, in use, the fuel lance can be fully received within the passage;

the fuel lance being shaped, at a first end thereof, for cooperation with a seating surface of the fuel injector and at a second end for cooperation with a connection arrangement comprising an inlet adapter;

the fuel lance having a bore therethrough to define a fluid flow path between the fuel injector and the connection arrangement;

wherein the fuel lance is provided with an external circumferential groove to receive a thrust clip for engagement with a surface of the inlet adapter, such that when the fuel lance is secured within the passage of the cylinder head by the inlet adapter, the surface of the inlet adapter exerts an axial load through the thrust clip along the length of the fuel lance to provide a sealing pressure between the first end of the fuel lance and the seating surface of the fuel injector.

28. The fuel supply line arrangement of claim 27, which further comprises a pipe nut for receiving a fuel pipe and arranged, in use, to engage the proximal region of the inlet adapter, such that a fuel flow path is established between the passage of the fuel pipe and the bore of the fuel lance.

29. A fuel supply line arrangement for an engine comprising a fuel injector to be located within a bore of an engine cylinder head, the supply line arrangement comprising: a fuel lance to be received in a passage provided in the cylinder head; a connection arrangement comprising an inlet adapter for securing the fuel lance within the passage; and a pipe nut for receiving a fuel pipe;

wherein the fuel lance comprises a tubular member of constant external diameter, arranged to be received, in use, within the passage and having a first end being shaped for cooperation with a seating surface of the fuel injector of the engine, and a second end being shaped for cooperation with the inlet adapter, and being provided with a bore therethrough to define a fuel flow path between the first end and the second end of the fuel lance;

the inlet adapter is provided with an attachment system for engaging a compatible attachment system of the cylinder head, and has a proximal region for receiving a high pressure fuel pipe, and wherein the inlet adapter has a distal region provided with an opening being adapted to receive the second end of the fuel lance; and the pipe nut is arranged, in use, to engage the proximal region of the inlet adapter, such that a fuel flow path is established between the passage of the fuel pipe and the bore of the fuel lance.

* * * * *